US011077539B2

(12) United States Patent
Arai

(10) Patent No.: US 11,077,539 B2
(45) Date of Patent: Aug. 3, 2021

(54) ELECTRIC MOTOR-DRIVEN TOOL, AND CONTROL DEVICE AND CONTROL CIRCUIT THEREFOR

(71) Applicant: NITTO KOHKI CO., LTD., Tokyo (JP)

(72) Inventor: Shota Arai, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 263 days.

(21) Appl. No.: 16/407,651

(22) Filed: May 9, 2019

(65) Prior Publication Data

US 2019/0262979 A1 Aug. 29, 2019

Related U.S. Application Data

(63) Continuation of application No. PCT/JP2017/040315, filed on Nov. 8, 2017.

(30) Foreign Application Priority Data

Nov. 10, 2016 (JP) ..... JP2016-219917

(51) Int. Cl.
*B25B 23/147* (2006.01)
*B25B 21/00* (2006.01)

(52) U.S. Cl.
CPC ..... *B25B 23/147* (2013.01); *B25B 21/002* (2013.01)

(58) Field of Classification Search
CPC ..... B25B 23/147; B25B 23/14; B25B 23/142; B25B 23/1422; B25B 23/1425
(Continued)

(56) References Cited

U.S. PATENT DOCUMENTS 3,616,864 A * 11/1971 Sorensen ..... F16D 43/20 173/176
3,643,749 A * 2/1972 Pauley ..... B25B 23/1453 173/176

(Continued)

FOREIGN PATENT DOCUMENTS

DE 102010056523 7/2012
DE 102014019441 6/2016

(Continued)

OTHER PUBLICATIONS

Office Action for corresponding DE Application No. 112017005671.3, dated Nov. 6, 2020.

(Continued)

*Primary Examiner* — Gloria R Weeks
(74) *Attorney, Agent, or Firm* — Burris Law, PLLC

(57) ABSTRACT

An electric motor-driven tool is configured to make a notification to a worker about a set value of tightening torque as necessary before starting tightening work. An electric motor-driven screwdriver includes an electric motor-driven screwdriver body capable of changing a setting of the magnitude of tightening torque to be applied when tightening a screw, and a notification device for making a notification to a worker about a set value of tightening torque. If the set value of tightening torque has been set to a value greater than a threshold value (reference value), a control circuit of the electric motor-driven screwdriver sends a notification execution signal to the notification device before the electric motor-driven screwdriver body is started to be driven, thereby enabling a notification to the worker to be made by the notification device.

8 Claims, 6 Drawing Sheets

(58) Field of Classification Search
USPC ..... 173/176
See application file for complete search history.

(56) References Cited

U.S. PATENT DOCUMENTS

| | | | | |
|---|---|---|---|---|
| 3,834,467 | A * | 9/1974 | Fuchs | B25B 23/1456 173/176 |
| 3,993,145 | A * | 11/1976 | Findeli | B25B 23/145 173/176 |
| 5,130,700 | A * | 7/1992 | Annis | G01R 19/16576 340/665 |
| 5,229,931 | A * | 7/1993 | Takeshima | G05B 19/0421 700/169 |
| 5,383,370 | A * | 1/1995 | Abramson | G01L 5/0042 73/862.23 |
| 6,371,218 | B1 * | 4/2002 | Amano | B25B 23/1405 173/176 |
| 7,069,816 | B1 * | 7/2006 | Saathoff | B25B 13/463 81/57.13 |
| 7,182,147 | B2 * | 2/2007 | Cutler | B25B 21/00 173/1 |
| 7,578,357 | B2 * | 8/2009 | Schell | B25B 23/1456 173/1 |
| 8,714,058 | B2 * | 5/2014 | Gauthier | A61B 17/8875 81/479 |
| 8,985,241 | B2 * | 3/2015 | Pozgay | B25F 5/02 173/217 |
| 2005/0263304 | A1 * | 12/2005 | Sainomoto | B25B 21/026 173/2 |
| 2007/0034394 | A1 * | 2/2007 | Gass | B25H 1/0092 173/2 |
| 2008/0173139 | A1 * | 7/2008 | Miyazaki | B25B 21/00 81/57.11 |
| 2011/0127941 | A1 | 6/2011 | Hirabayashi et al. | |
| 2013/0133912 | A1 * | 5/2013 | Mizuno | B25B 23/1405 173/180 |
| 2013/0233584 | A1 | 9/2013 | Mashiko | |
| 2014/0331831 | A1 * | 11/2014 | King | B25B 23/1425 81/479 |
| 2018/0185993 | A1 | 7/2018 | Hita et al. | |

FOREIGN PATENT DOCUMENTS

| | | |
|---|---|---|
| EP | 2671681 | 12/2013 |
| EP | 3750671 | 12/2020 |
| JP | 2009083040 | 4/2009 |
| JP | 2011110668 | 6/2011 |
| JP | 2013184266 | 9/2013 |
| JP | 2015188943 | 11/2015 |
| JP | 2015221494 | 12/2015 |
| TW | M394880 | 12/2010 |

OTHER PUBLICATIONS

International Search Report for International Application PCT/JP2017/040315, dated Dec. 19, 2017.

Office Action for corresponding GB application No. 1906187.8, dated May 28, 2021.

* cited by examiner

ELECTRIC MOTOR-DRIVEN TOOL, AND CONTROL DEVICE AND CONTROL CIRCUIT THEREFOR

CROSS-REFERENCE TO RELATED APPLICATIONS

This application is a continuation of International Application No. PCT/JP2017/040315, filed on Nov. 8, 2017, which claims priority to and the benefit of JP 2016-219917 filed on Nov. 10, 2016. The disclosures of the above applications are incorporated herein by reference.

FIELD

The present disclosure relates to an electric motor-driven tool having an electric motor-driven tool body capable of changing the setting of the magnitude of tightening torque to be applied when tightening a threaded member and also relates to a control device and a control circuit for the electric motor-driven tool. More specifically, the present invention relates to an electric motor-driven tool configured to make a notification to a worker about the magnitude of the set value of tightening torque before the electric motor-driven tool body is started to be driven, and also relates to a control device and a control circuit for the electric motor-driven tool.

BACKGROUND

With electric motor-driven tools for tightening threaded members such as screws and nuts, there may be a situation where the tightening torque needs to be changed according to the type of screws, etc., or an object to be fastened with threaded members. Therefore, some electric motor-driven tools of the type described above are provided with an electrical or mechanical torque control mechanism to enable setting change of the magnitude of tightening torque (Patent Literature 1). Meanwhile, at factory production lines, tightening work for different types of screws may be continuously carried out in a predetermined sequence. Some electric motor-driven tools used in the above-described case are configured such that the electric motor-driven tool itself judges the completion of a predetermined working process carried out with the same settings, and when the working process is going to shift to the subsequent process, the electric motor-driven tool automatically changes the set value of tightening torque to a set value required in the subsequent process.

CITATION LIST

Patent Literature

Patent Literature 1: Japanese Patent Application Publication No. 2015-188943

SUMMARY

Technical Problem

When the set value of tightening torque is changed, the magnitude of reaction force applied to the worker's hand gripping the electric motor-driven tool during tightening work also changes according to the change of the set value. If the worker always has a grasp of the set value of tightening torque that has been set at that time and has a grasp of the level of magnitude of reaction force supposed to act on his or her hand with the set value, the worker can make preparations in advance, for example, by adjusting the gripping force in accordance with the assumed magnitude of reaction force. However, the worker cannot always grasp the set value of tightening torque correctly. In particular, when the set value is automatically changed, the worker may not be aware of the fact that a setting change has been made. On such an occasion, the worker may unexpectedly receive a reaction force greater than is expected due to the fact that the tightening torque has been set to a value larger than is assumed. In such a case, the worker may be unable to keep gripping the electric motor-driven tool appropriately, so that the electric motor-driven tool may rotate by reaction to the tightening torque, resulting in a failure to tighten the threaded member with an appropriate torque. There is also a danger of the electric motor-driven tool dropping off the worker's hand, depending on the situation.

Under the above-described circumstances, an object of the present invention is to provide an electric motor-driven tool configured to make a notification to a worker about a set value of tightening torque as necessary before starting tightening work, thereby enabling the worker to be notified of the fact that a relatively large torque will be applied in advance, and also to provide a control device and a control circuit for the electric motor-driven tool.

Solution to Problem

The present invention provides a control circuit for use in an electric motor-driven tool. The electric motor-driven tool has an electric motor-driven tool body capable of changing a setting of a magnitude of tightening torque to be applied when tightening a threaded member, and a notification device for making a notification to a worker about a set value of the tightening torque. The control circuit is configured such that if the set value of tightening torque for the electric motor-driven tool body has been set to a value greater than a reference value, the control circuit sends a notification execution signal to the notification device before the electric motor-driven tool body is started to be driven, thereby enabling a notification to the worker to be made by the notification device.

The control circuit enables a worker using an electric motor-driven tool having the control circuit to be notified of the fact that the set value of tightening torque has been set to a value greater than a reference value before the electric motor-driven tool body is driven. Accordingly, the worker using the electric motor-driven tool can know in advance that a relatively large reaction force will be applied in association with driving of the electric motor-driven tool body, and the worker can make preparations in advance in anticipation of the large reaction force. Consequently, it is possible to prevent a situation where the electric motor-driven tool rotates by reaction to the tightening torque, resulting in a failure to tighten the threaded member with an appropriate torque, and a situation where the electric motor-driven tool slips out of the worker's hand.

Specifically, the reference value may be a predetermined threshold value.

Alternatively, the reference value may be a value obtained by adding a predetermined acceptable variation value to the preceding set value before setting change of the set value.

Alternatively, the arrangement may be as follows. The reference value includes a first reference value and a second reference value. The first reference value is a predetermined threshold value, and the second reference value is a value obtained by adding a predetermined acceptable variation value to a preceding set value before setting change of the set value. The control circuit is configured such that if the set value of tightening torque which has been set for the electric motor-driven tool body is greater than at least one of the first reference value and the second reference value, the control circuit sends the notification execution signal to the notification device.

In addition, the present invention provides an electric motor-driven tool including: an electric motor-driven tool body capable of changing a setting of the magnitude of tightening torque to be applied when tightening a threaded member; a notification device for making a notification to a worker about a set value of the tightening torque; and any one of the above-described control circuits.

In this case, the notification made by the notification device may be at least one of a notification by a visual indication, a notification by a sound indication, and a notification made by temporarily disabling the electric motor-driven tool body from being driven.

Specifically, the arrangement may be as follows. The notification includes at least the notification made by temporarily disabling the electric motor-driven tool body from being driven. The electric motor-driven tool body has a notification cancellation operation part. The electric motor-driven tool body is disabled from being started to be driven for a period of time from when the notification is made by the notification device until the notification cancellation operation part is actuated to cancel the notification.

In addition, the present invention provides a control device having any one of the above-described control circuits. The control device is communicatively connectable to at least one electric motor-driven tool body separate from the control device. The electric motor-driven tool body is capable of changing a setting of the magnitude of tightening torque to be applied when tightening a threaded member. The control device is configured to control the electric motor-driven tool body communicatively connected thereto.

Embodiments of an electric motor-driven tool according to the present invention will be explained below on the basis of the accompanying drawings.

DRAWINGS

DETAILED DESCRIPTION

Figure 1:
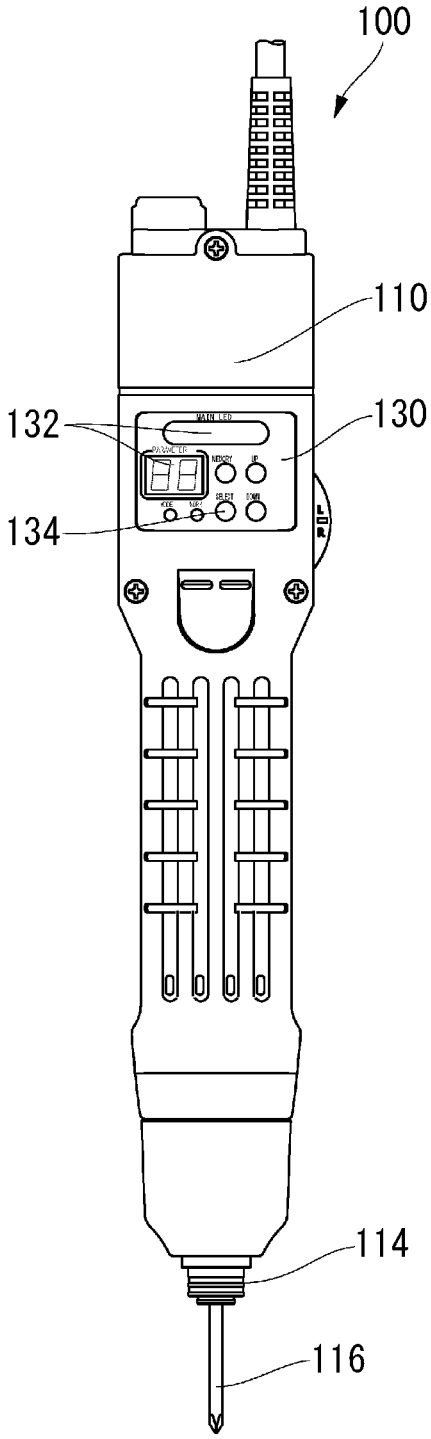
FIG. 1 is an external view of an electric motor-driven screwdriver according to a first embodiment of the present invention.
Figure 2:
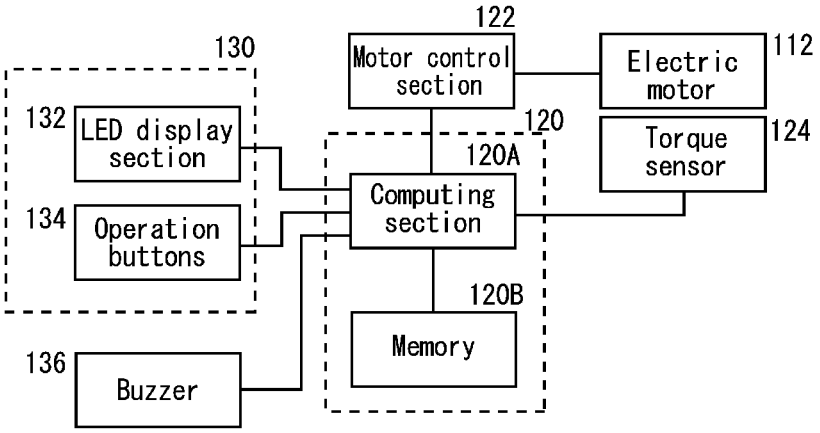
FIG. 2 is a functional block diagram of the electric motor-driven screwdriver shown in FIG. 1.

An electric motor-driven screwdriver (electric motor-driven tool) 100 according to a first embodiment of the present invention includes, as shown in FIGS. 1 and 2, an electric motor-driven screwdriver body (electric motor-driven tool body) 110 having a bit holder 114 configured to be driven to rotate by a built-in electric motor 112 (not shown in FIG. 1), and a control circuit 120 (not shown in FIG. 1) disposed in the electric motor-driven screwdriver body 110. The bit holder 114 is detachably fitted with a screwdriver bit 116 which is appropriately selected in accordance with screws to be tightened. The electric motor-driven screwdriver body 110 is further provided with an interface unit 130 having an LED display section 132 and a plurality of operation buttons 134. The electric motor-driven screwdriver 100 has in the electric motor-driven screwdriver body 110 a starting switch (not shown) for starting the electric motor 112. The starting switch is turned on when the screwdriver bit 116 fitted to the bit holder 114 is pressed against a screw. This causes a motor control section 122 to start driving of the electric motor 112.

The electric motor-driven screwdriver 100 further includes a torque sensor 124 for detecting the driving torque of the electric motor 112. The control circuit 120 has a computing section 120A for performing various arithmetic processing operations, and a memory 120B for storing data such as setting parameters.

The electric motor-driven screwdriver body 110 is capable of changing the setting of the magnitude of tightening torque. Specifically, electric power to be supplied to the electric motor 112 is appropriately controlled by the motor control section 122 on the basis of the magnitude of torque detected by the torque sensor 124, thereby controlling the torque of the electric motor 112 so that tightening torque applied to a screw is limited within a range of set values of tightening torque which has previously been set before starting drive. Set values of tightening torque can be changed by using the operation buttons 134 of the interface unit 130 or an external setting device (not shown) communicatively connected to the electric motor-driven screwdriver body 110.

Further, the electric motor-driven screwdriver 100 may be configured to enable the set value of the magnitude of tightening torque to be automatically changed when it is necessary to change the magnitude of tightening torque in such a case that a single worker tightens different types of screws sequentially and continuously at a production line or the like. In this case, setting parameters to be used at each of tightening processes in a series of work processes including a plurality of different tightening processes are stored in the memory 120B in advance. When one process proceeds to a subsequent process upon completion of the present process, the computing section 120A reads from the memory 120B setting parameters to be used in the subsequent process, and automatically changes settings of the electric motor-driven screwdriver body 110. Assuming, for example, that a first process is screw tightening work for tightening three screws of the same type, and that a second process is screw tightening work for tightening two screws different in type from the screws in the first process, the electric motor-driven screwdriver body 110 is driven according to first setting parameters to tighten three screws in the first process, and upon completion of the first process, the computing section 120A reads second setting parameters for the second process from the memory 120B and automatically changes the settings from the first setting parameters to the second setting parameters. During the second process, the electric motor-driven screwdriver body 110 is driven on the basis of the set value until completion of tightening the two screws. Thereafter, each time one process is completed, the setting parameters are automatically changed to the setting parameters for the subsequent process. It should be noted that the setting parameters may include, for example, items such as the rotational speed and rotation time of the electric motor 112, as necessary, in addition to the above-described set value of tightening torque.

The electric motor-driven screwdriver 100 is configured as follows. When the set value of tightening torque included in the setting parameters is changed, the changed set value is compared with a reference value (described later), and a predetermined notification (described later) is made to the worker if the set value has been set to a value greater than the reference value. Consequently, the worker can know before starting screw tightening work that a relatively large torque will be generated when driving the electric motor-driven screwdriver 100 subsequently.

Notifications made to the worker in this embodiment include a notification using a visual indication by flashing the LED display section 132, a notification using a sound indication by a beep from a buzzer 136, and a notification made by temporarily disabling the electric motor 112 of the electric motor-driven screwdriver body 110 from being driven. These notifications are made according to notification execution signals from the control circuit 120, and these three notifications are executed simultaneously. It should be noted that if notification devices such as the LED display section 132 and the buzzer 136 do not include an electronic circuit, the notification execution signals from the control circuit 120 are driving electric currents supplied directly to the notification devices to supply electric power for driving the notification devices. If the notification devices include electronic circuits, the notification execution signals are input signals to the electronic circuits. If any of the notification devices includes a switch of an electric circuit, e.g. a relay or a transistor, and is configured such that a notification is executed in response to the opening-closing of the switch, the associated notification execution signal is a contact signal for opening-closing the relay or other switch. Notification devices of various forms are usable depending on the type of the control circuit, whether or not there is the control circuit, and so forth. Accordingly, notification execution signals of various forms are appropriately selected according to the forms of notification devices used. The notification execution signal may be in any form, provided that the notification execution signal is sent to the associated notification device so as to make a notification to the worker by the notification device. After having been made, the notifications can be cancelled by pressing an operation button (notification cancellation operation part) 134 of the interface unit 130. As a result of the cancellation of the notifications, the electric motor 112 returns to a drivable state to enable screw tightening work.

Figure 3:
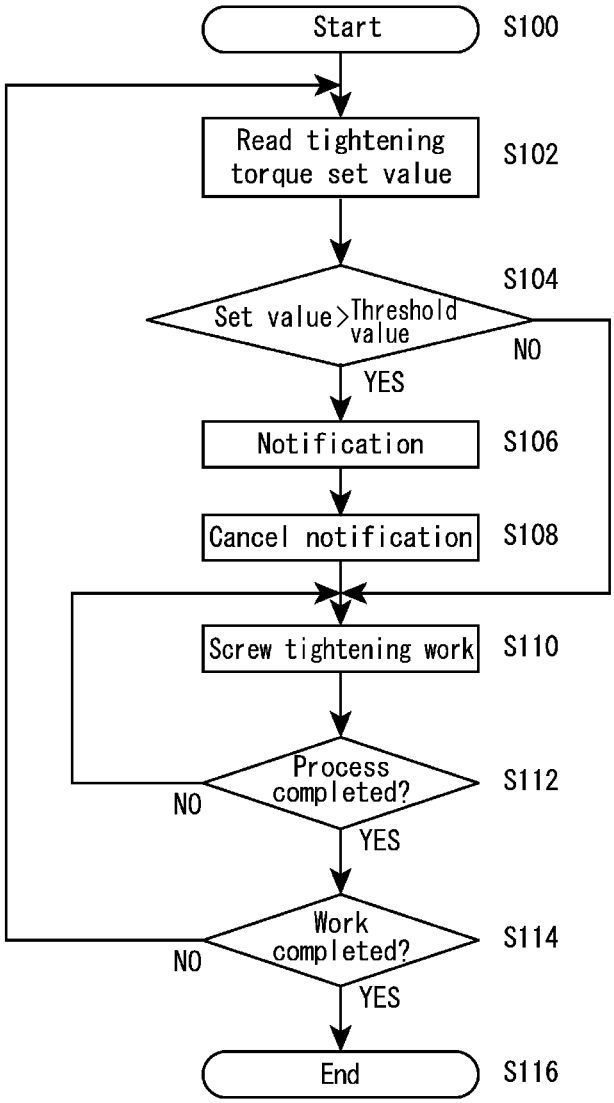
FIG. 3 is a first flowchart showing a notification operation of the electric motor-driven screwdriver in FIG. 1.

Setting parameters including a set value of tightening torque may be changed by either manually or automatically, as stated above. In the following, the notification operation of the electric motor-driven screwdriver 100 will be explained in more detail by taking, as an example, a case where the set value of tightening torque is changed automatically. As shown in FIG. 3, when the electric motor-driven screwdriver 100 is started (S100), the computing section 120A of the control circuit 120 reads from the memory 120B the set value of tightening torque for a first process (S102). Next, the computing section 120A compares the set value of tightening torque with a preset threshold value (reference value) (S104). If the set value has been set to a value greater than the threshold value, the computing section 120A judges that it is necessary to make a notification to the worker, and sends a notification execution signal to each notification device to instruct the notification device to make a notification (S106). Specifically, notification execution signals are sent to the LED display section 132, the buzzer 136, and the motor control section 122, respectively. Consequently, the LED display section 132 flashes the LEDs, and the buzzer 136 beeps. The motor control section 122 disables the electric motor 112 from being driven even if the drive switch is turned on. If the operation button 134, which functions as a notification cancellation operation part of the interface unit 130, is pressed in a state where the notifications are being made, the notifications are canceled, and the flashing of the LED display section 132 and the beep from the buzzer 136 are stopped. In addition, the motor control section 122 enables the electric motor 112 to be driven (S108). Thus, tightening work is allowed to be performed (S110). The screw tightening work (S110) is repeated until completion of a predetermined screw tightening process which has been set as a first process. If there is a subsequent process to be carried out after completion of the present process (S112), the computing section 120A reads setting parameters for the subsequent process (S102) and changes the set value of tightening torque, and so forth. The computing section 120A compares the changed set value of tightening torque with the threshold value in the same way as the above (S104). If the set value has been set to a value greater than the threshold value, a notification operation is performed (S106). Thereafter, a similar operation is repeated. Upon completion of all processes (S114), the control including the notification operation is completed (S116). In the above-descried embodiment, a notification is made only when the set value is changed, and no notification is made before the second and following screw tightening work in the same process, as stated above. It should, however, be noted that when performing screw tightening work a plurality of times with a set value for which a notification is judged to be necessary, a notification may be made every before starting the screw tightening work.

Figure 4:
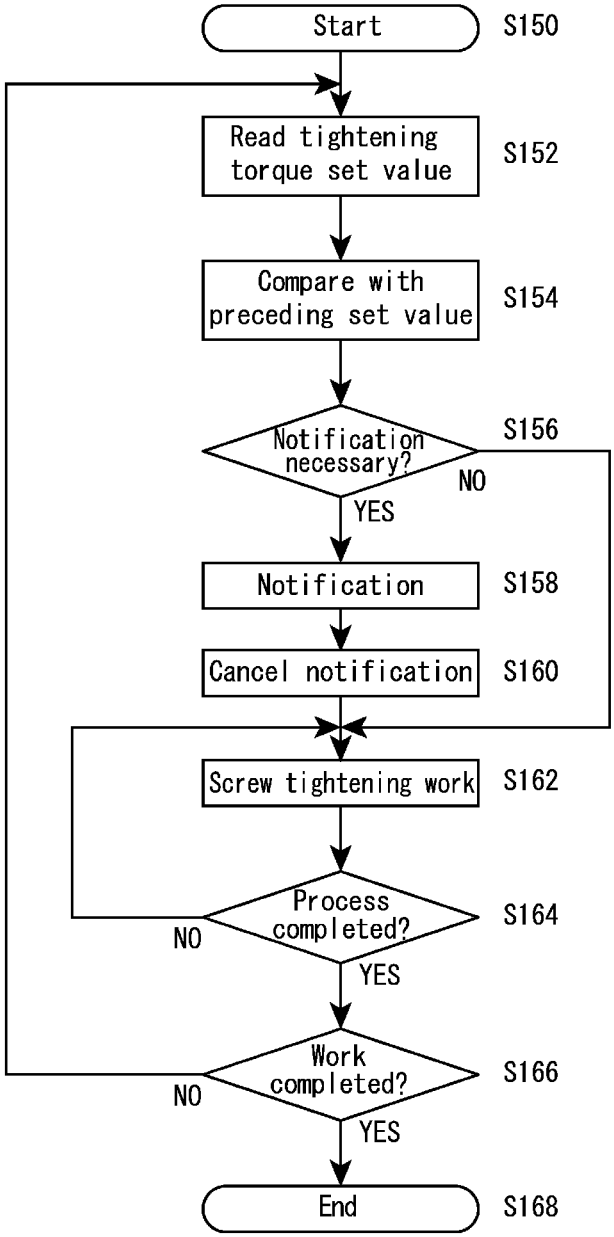
FIG. 4 is a second flowchart showing the notification operation of the electric motor-driven screwdriver in FIG. 1.

The judgment as to whether or not a notification is necessary may be made, as shown in FIG. 4, by comparing the present set value of tightening torque with the preceding set value which was set before setting change (S154 and S156). Specifically, a predetermined acceptable variation value stored in the memory 120B is added to the preceding set value to obtain a reference value, and if the present set value has been set to a value greater than the reference value, it is judged that a notification is necessary, and a notification operation similar to that shown in FIG. 3 is carried out. It should be noted that, in this embodiment, first, the preceding set value is subtracted from the present set value in the comparison between the preceding set value and the present set value (S154), and if the value resulting from the subtraction is greater than the acceptable variation value, it is judged that a notification is necessary (S156). This arithmetic operation is substantially identical with judging whether or not the present set value is greater than the above-described reference value (the value obtained by adding the acceptable variation value to the preceding set value). It is a matter of design to be appropriately selected how the computing section 120A specifically performs arithmetic operations to judge whether or not a notification is necessary by comparing the preceding set value and the present set value. Therefore, a computational procedure other than the above is, of course, conceivable. The steps (S150-152, and S158-168) other than the steps for judging whether or not a notification is necessary are the same as the corresponding steps (S100-102, and S106-116) in the method shown in FIG. 3.

Figure 5:
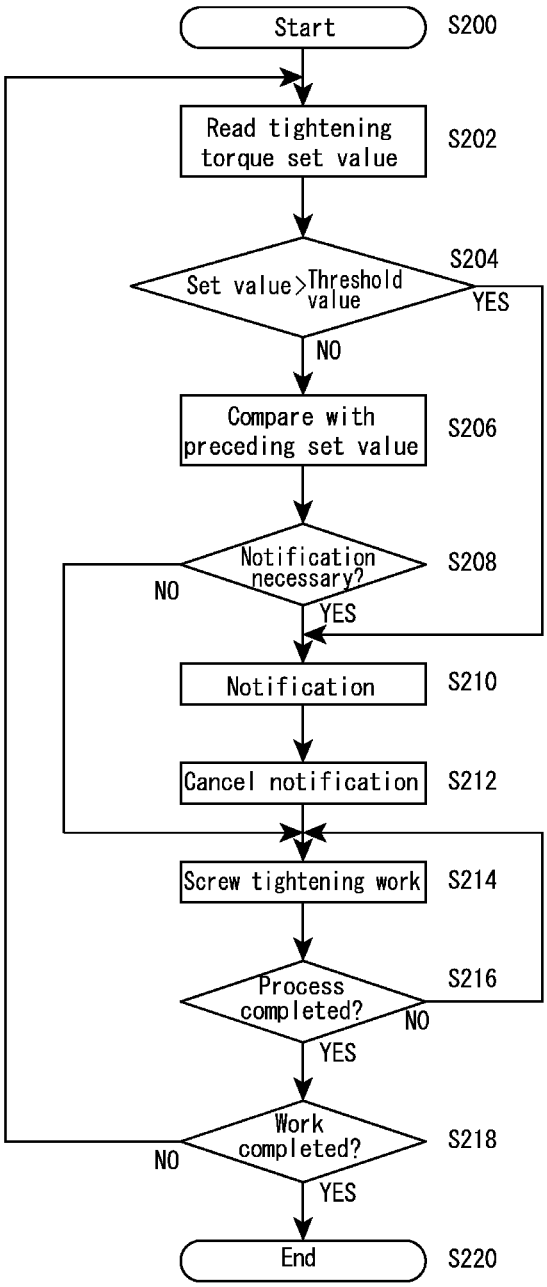
FIG. 5 is a third flowchart showing the notification operation of the electric motor-driven screwdriver in FIG. 1.

The judgment as to whether or not a notification is necessary may be made, as shown in FIG. 5, by a combination of the method (S104 and S106) shown in FIG. 3 and the method (S154 and S156) shown in FIG. 4. That is, first, a comparison is made between the present set value of tightening torque and a predetermined threshold value (first reference value) (S204). A notification is made if the present set value has been set to a value greater than the threshold value (S210). If the present set value is not greater than the threshold value, the present set value is next compared with a value (second reference value) obtained by adding a predetermined acceptable variation value to the preceding set value (S206). A notification is made (S210) if the present set value has been set to a value greater than the value resulting from the addition, but no notification is made if the present set value is not greater than the value resulting from the addition. In short, in this case, a notification is made if the present set value has been set to a value greater than at least one of the first reference value (predetermined threshold value) and the second reference value (value obtained by adding a predetermined acceptable variation value to the preceding set value).

The steps (S200-202 and S210-220) other than the steps for judging whether or not a notification is necessary in the method shown in FIG. 5 are the same as the corresponding steps (S100-102, and S106-116) in the method shown in FIG. 3. It should be noted that the control circuit 120 of the electric motor-driven screwdriver 100 according to this embodiment allows selection of any of the three methods shown in FIGS. 3 to 5 for the judgment as to whether or not a notification is necessary.

In the electric motor-driven screwdriver 100, the set value of tightening torque is assessed before the electric motor 112 is started to be driven, and if the set value has been set to a value greater than a variously set reference value, a notification of this fact is made to the worker. Accordingly, the worker can know before starting tightening work that a relatively large tightening torque will be generated, so that the worker can make adequate preparations for an expected large reaction force, for example, by gripping the electric motor-driven screwdriver body 110 with a correspondingly large force. Consequently, it is possible to prevent a situation where the electric motor-driven screwdriver body 110 rotates considerably by reaction, so that the screw cannot be tightened with an appropriate torque, resulting in a tightening failure, and a situation where the electric motor-driven screwdriver body 110 slips out of the worker's hand.

Figure 6:
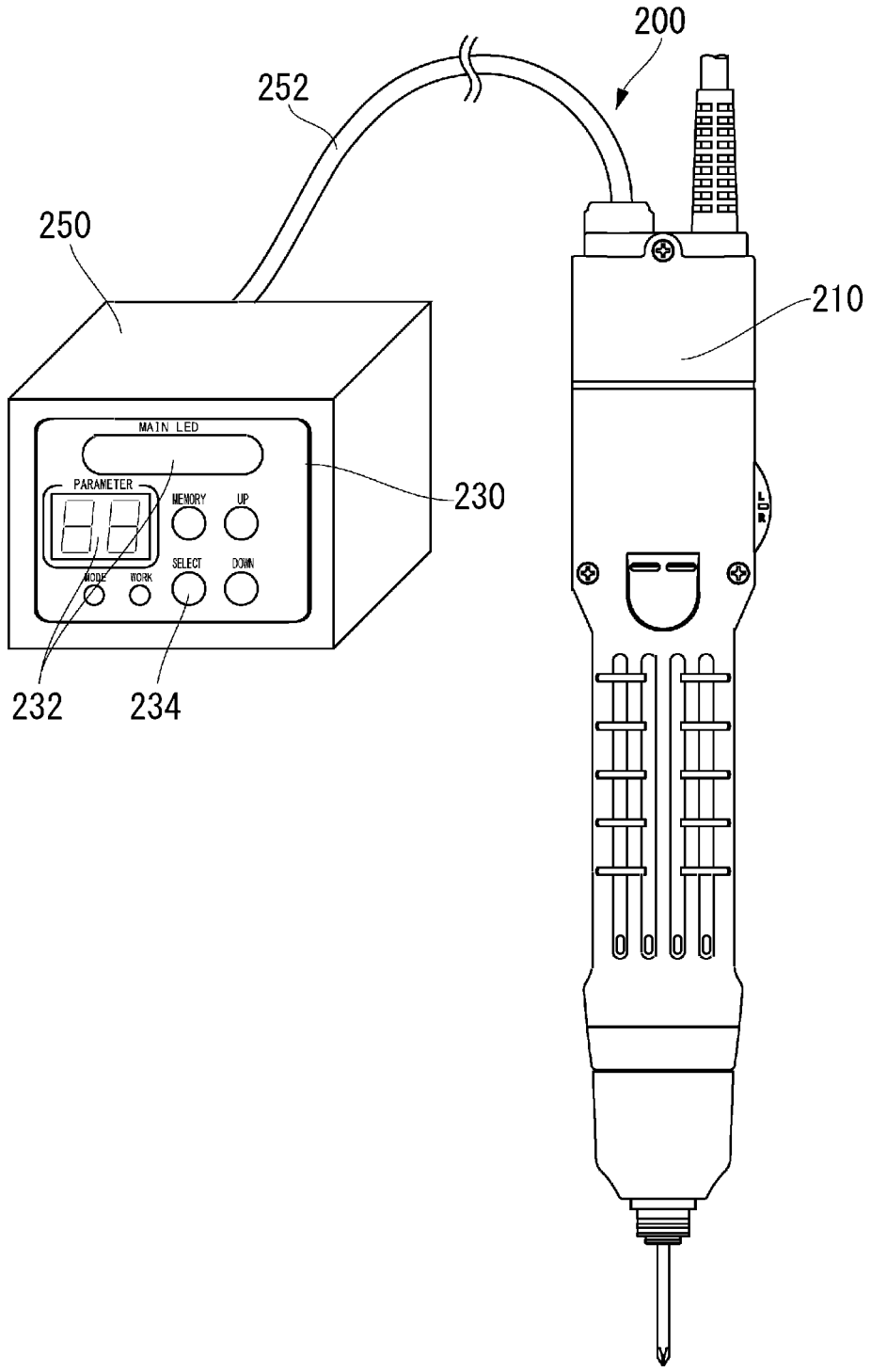
FIG. 6 is an external view of an electric motor-driven screwdriver according to a second embodiment of the present invention.

An electric motor-driven screwdriver 200 according to a second embodiment of the present invention comprises, as shown in FIG. 6, an electric motor-driven screwdriver body 210 and a control device 250 prepared as a member separate from the electric motor-driven screwdriver body 210. The control device 250 has an interface unit 230 disposed therein. The interface unit 230 has an LED display section 232 and operation buttons 234. The control device 250 further has a control circuit 120 (FIG. 2) built therein to control the electric motor-driven screwdriver body 210. The configuration and function of the control circuit 120 of the electric motor-driven screwdriver 200 are the same as those of the control circuit 120 of the electric motor-driven screwdriver 100 according to the first embodiment. The control device 250 and the electric motor-driven screwdriver body 210 are communicatively connected through a cable 252. Although in the illustrated electric motor-driven screwdriver 200 only one electric motor-driven screwdriver body 210 is connected to the control device 250, the control device 250 may be connected to a plurality of electric motor-driven screwdriver bodies 210 simultaneously to control the electric motor-driven screwdriver bodies 210 simultaneously. In such a case, the memory 120B has stored therein setting parameters for each of the plurality of electric motor-driven screwdriver bodies 210. The threshold value and the acceptable variation value for judging whether or not a notification is necessary may be values common to all the electric motor-driven screwdriver bodies 210. Alternatively, the threshold value and the acceptable variation value may be set differently for each of the electric motor-driven screwdriver bodies 210. When a plurality of electric motor-driven screwdriver bodies 210 are supposed to be used by a single worker, the preceding set value of tightening torque in FIGS. 4 and 5 may be the tightening torque set value used in the preceding tightening work regardless of whether the electric motor-driven screwdriver body 210 used in the preceding tightening work and the electric motor-driven screwdriver body 210 to be used subsequently are the same or different from each other. Further, the LED display section 232 and the buzzer 136 which function as notification devices and the operation buttons 234 which function as the notification cancellation operation part may be provided on the electric motor-driven screwdriver body 210, or alternatively, may be provided on both the electric motor-driven screwdriver body 210 and the control device 250.

Although the electric motor-driven screwdrivers 100 and 200 have been explained above as one embodiment of the electric motor-driven tool according to the present invention, the present invention is not limited thereto but may be modified in various ways as follows.

For example, the electric motor-driven tool according to the present invention may be a tool for tightening threaded members other than screws, e.g. nuts. Further, the foregoing embodiments are configured to simultaneously perform a notification by a visual indication, a notification by a sound indication, and a notification made by temporarily disabling the electric motor-driven tool body from being driven, as notification methods. The arrangement may, however, be configured to give only one or two of the three notifications. It is also possible to use a notification method other than the above three. The cancellation of notification is not limited to that using a cancellation button but may be made by other method, for example, one in which the notification is automatically cancelled when a predetermined time has elapsed. Further, it is also possible to give different notifications according to the magnitude of the tightening torque set value, for example, by setting a plurality of threshold values and acceptable variation values and changing the color of LEDs or changing the beeping sound according to the magnitude of the tightening torque set value.

Although in the foregoing embodiments the control of tightening torque is achieved by electrical control, i.e. controlling electric power to be supplied to the electric motor, the tightening torque control may be realized by mechanical control, i.e. changing the setting of the clutch action starting torque in a mechanical clutch mechanism. The mechanical clutch mechanism is usually configured as follows. One of two clutch plates is urged toward the other clutch plate by a spring, and the one clutch plate is forced to separate from the other clutch plate against the urging force of the spring by the torque applied between the clutch plates during screw tightening work, thereby canceling the connection between the clutch plates in the rotational direction, and thus canceling power transmission between the clutch plates. Accordingly, it is possible to change the magnitude of the clutch action starting torque, i.e. the set value of tightening torque, by adjusting the urging force of the spring. If this type of clutch mechanism is employed, the arrangement may be as follows. The control circuit 120 obtains the present set value of tightening torque on the basis of a signal from a sensor detecting the urging force of the spring directly or indirectly. Alternatively, the clutch mechanism is equipped with a mechanism changing the urging force of the spring on the basis of an external signal, and the control circuit 120 sends a signal relating to the set value of tightening torque to the clutch mechanism to change the clutch action starting torque of the clutch mechanism, thereby changing the set value of tightening torque.

LIST OF REFERENCE SIGNS

Electric motor-driven screwdriver (electric motor-driven tool) 100; electric motor-driven screwdriver body (electric motor-driven tool body) 110; electric motor 112; bit holder 114; screwdriver bit 116; control circuit 120; computing section 120A; memory 120B; motor control section 122; torque sensor 124; interface unit 130; display section 132; operation buttons 134; buzzer 136; electric motor-driven screwdriver 200; electric motor-driven screwdriver body 210; interface unit 230; display section 232; input buttons 234; control device 250; cable 252.

What is claimed is:

1. A control circuit for use in an electric motor-driven tool, the electric motor-driven tool having an electric motor-driven tool body capable of changing a setting of a magnitude of tightening torque to be applied when tightening a threaded member, and a notification device for making a notification to a worker about a set value of the tightening torque;

the control circuit being configured such that if the set value of tightening torque for the electric motor-driven tool body has been set to a value greater than a reference value, the control circuit sends a notification execution signal to the notification device before the electric motor-driven tool body is started to be driven, thereby enabling a notification to the worker to be made by the notification device.

2. The control circuit of claim 1, wherein the reference value is a predetermined threshold value.

3. The control circuit of claim 1, wherein the reference value is a value obtained by adding a predetermined acceptable variation value to a preceding set value before setting change of the set value.

4. The control circuit of claim 1, wherein the reference value includes a first reference value and a second reference value;

the first reference value being a predetermined threshold value, and the second reference value being a value obtained by adding a predetermined acceptable variation value to a preceding set value before setting change of the set value;

wherein the control circuit is configured such that if the set value of tightening torque which has been set for the electric motor-driven tool body is greater than at least one of the first reference value and the second reference value, the control circuit sends the notification execution signal to the notification device.

5. An electric motor-driven tool comprising:

an electric motor-driven tool body capable of changing a setting of a magnitude of tightening torque to be applied when tightening a threaded member;

a notification device for making a notification to a worker about a set value of the tightening torque; and the control circuit of claim 1.

6. The electric motor-driven tool of claim 5, wherein the notification made by the notification device is at least one of a notification by a visual indication, a notification by a sound indication, and a notification made by temporarily disabling the electric motor-driven tool body from being driven.

7. The electric motor-driven tool of claim 6, wherein the notification includes at least the notification made by temporarily disabling the electric motor-driven tool body from being driven;

the electric motor-driven tool body having a notification cancellation operation part; and the electric motor-driven tool body being disabled from being started to be driven for a period of time from when the notification is made by the notification device until the notification cancellation operation part is actuated to cancel the notification.

8. A control device having the control circuit of claim 1, the control device being communicatively connectable to at least one electric motor-driven tool body separate from the control device, the electric motor-driven tool body being capable of changing a setting of a magnitude of tightening torque to be applied when tightening a threaded member, the control device being configured to control the electric motor-driven tool body communicatively connected thereto.

* * * * *